US010532752B2

(12) United States Patent
Hubmann et al.

(10) Patent No.: US 10,532,752 B2
(45) Date of Patent: Jan. 14, 2020

(54) CHASSIS FRAME FOR A RAIL VEHICLE

(71) Applicant: SIEMENS AG ÖSTERREICH, Vienna (AT)

(72) Inventors: Markus Hubmann, Brodingberg (AT); Radovan Seifried, Maribor (SI)

(73) Assignee: Siemens Mobility GMBH, Vienna (AT)

( * ) Notice: Subject to any disclaimer, the term of this patent is extended or adjusted under 35 U.S.C. 154(b) by 202 days.

(21) Appl. No.: 15/554,961

(22) PCT Filed: Feb. 24, 2016

(86) PCT No.: PCT/EP2016/053855
§ 371 (c)(1),
(2) Date: Aug. 31, 2017

(87) PCT Pub. No.: WO2016/139098
PCT Pub. Date: Sep. 9, 2016

(65) Prior Publication Data

US 2018/0029616 A1 Feb. 1, 2018

(30) Foreign Application Priority Data

Mar. 3, 2015 (AT) ..... A 50167/2015

(51) Int. Cl.
*B61F 5/52* (2006.01)
*B61F 1/08* (2006.01)

(52) U.S. Cl.
CPC . *B61F 1/08* (2013.01); *B61F 5/52* (2013.01)

(58) Field of Classification Search
CPC ..... B61F 5/52; B61F 1/12; B61F 5/04; B61F 1/08; B61F 5/00
See application file for complete search history.

(56) References Cited

U.S. PATENT DOCUMENTS 994,093 A * 5/1911 Covert ..... B61F 5/52 105/205
1,661,833 A * 3/1928 Kadel ..... B61F 5/52 105/205
2014/0261061 A1 9/2014 Chu et al.

FOREIGN PATENT DOCUMENTS

CN 1068552 C 7/2001
CN 201882093 6/2011
CN 102265057 11/2011
(Continued)

*Primary Examiner* — Mark T Le
(74) *Attorney, Agent, or Firm* — Cozen O'Connor

(57) ABSTRACT

A chassis frame for a rail vehicle includes a plurality of longitudinal beams formed as I-beams, wherein each longitudinal beam includes a longitudinal beam top flange, a longitudinal beam bottom flange and a web, a box-shaped transverse beam interconnecting the plurality of longitudinal beams, each longitudinal beam having a central section in which the longitudinal beam is connected to the transverse beam, where each longitudinal beam forms at least one wheelset guide bushing for connection to a wheelset guide, where a stiffening rib is arranged in each longitudinal beam on both sides of the web, and where the stiffening rib extends outward from the web in a transverse direction on both sides of the web and is configured such that the force flow from the wheelset guide bushing is conducted into the transverse beam such that the shear stiffness and transverse stiffness of the chassis frame is increased.

24 Claims, 3 Drawing Sheets

(56) References Cited

FOREIGN PATENT DOCUMENTS

| | | | |
|---|---|---|---|
| CN | 102490754 | | 6/2012 |
| CN | 103128457 | | 6/2013 |
| DE | 19506586 | C1 | 8/1996 |
| EP | 0685377 | | 12/1995 |
| EP | 2669138 | | 12/2013 |
| EP | 2454139 | B1 | 5/2014 |
| EP | 2783939 | | 10/2014 |
| WO | WO2008000657 | | 1/2008 |
| WO | WO2010072428 | | 7/2010 |
| WO | WO2013178716 | | 12/2013 |
| WO | WO 2015/024745 | | 2/2015 |

* cited by examiner

CHASSIS FRAME FOR A RAIL VEHICLE

CROSS-REFERENCE TO RELATED APPLICATIONS

This is a U.S. national stage of application No. PCT/EP2016/053855 filed 24 Feb. 2016. Priority is claimed on Austrian application No. A50167/2015 filed Mar. 3, 2015, the content of which is incorporated herein by reference in its entirety.

BACKGROUND OF THE INVENTION

1. Field of the Invention

The invention relates to a chassis frame for a rail vehicle having two longitudinal supports that extend parallel to a longitudinal direction and are configured as I-beams, where the longitudinal support comprises a longitudinal support top flange, a longitudinal support bottom flange and a web, and including a box-shaped transverse support that extends normal to the longitudinal direction and parallel to a transverse direction and connects the two longitudinal supports to one another, where the longitudinal support has a central portion in which the longitudinal support top flange and the longitudinal support bottom flange are arranged parallel to one another and in which the longitudinal support is connected to the transverse support, and where each longitudinal support forms at least one wheelset guide bushing for connecting to a wheelset guide.

2. Description of the Related Art

Chassis, also known as wheel trucks, of rail vehicles typically have two wheelsets that are guided on rails and are connected to superstructures of the rail vehicle. An essential component of a chassis is a chassis frame to which the wheelsets are connected, for example, via a wheelset guide or a primary suspension, and the superstructure is connected, for example, via a secondary suspension, and a device for force transmission is connected. The force flows between the individual components extend thereby mainly via the chassis frame that has a longitudinal direction and a transverse direction, where the longitudinal direction points in the direction of travel of the rail vehicle and the transverse direction lies perpendicular to the longitudinal direction.

Taking into account the criteria of lightweight construction, the weight of the chassis frame is thus constantly being further reduced. The longitudinal supports of the chassis frame, which in the past were constructed in a box-shape, i.e., comprised a top flange, a bottom flange and side walls, are increasingly implemented as I-beams with an open profile, comprising a longitudinal support top flange, a longitudinal support bottom flange and a web connecting them. Although through the use of I-beams as longitudinal supports, a desired reduction in the torsional stiffness of the chassis frame, i.e., a reduced resistance to twisting about a transverse axis of the transverse support extending parallel to the transverse direction, is achieved, disadvantages arise with regard to the shearing rigidity of the chassis frame, i.e., the resistance to deformation by shear forces that act parallel to the longitudinal direction and the transverse rigidity of the chassis frame, i.e., the resistance to deformation through transverse forces that act parallel to the transverse direction.

In particular, when the wheelset guide is connected via a wheelset guide bushing arranged in the longitudinal support and thus high shear forces and transverse forces act on the longitudinal support that is loaded in the region of the web, or act on the whole chassis frame, in accordance with the prior art, only the overdimensioning of the longitudinal supports via high wall thicknesses is known, so that the weight savings and the lessening of the torsional stiffness is thereby limited by constructional means.

SUMMARY OF THE INVENTION

In view of the foregoing, it is therefore an object of the invention to provide a chassis frame that enables a reduction of the weight and a reduction of the torsional stiffness of the chassis frame and simultaneously fulfils the design specifications in relation to shearing rigidity and transverse rigidity such that the disadvantages of the prior art are overcome.

These and other objects and advantages are achieved in accordance with the invention by a chassis frame for a rail vehicle, having two longitudinal supports that extend parallel to a longitudinal direction and are configured as I-beams, the longitudinal support comprising a longitudinal support top flange, a longitudinal support bottom flange and a web, and including a box-shaped transverse support that extends normal to the longitudinal direction parallel to a transverse direction and connects the two longitudinal supports to one another, where the longitudinal support has a central portion in which the longitudinal support top flange and the longitudinal support bottom flange are arranged parallel to one another and in which the longitudinal support is connected to the transverse support, and where each longitudinal support forms at least one wheelset guide bushing for connecting to a wheelset guide.

In accordance with the invention, on both sides of the web, at least one stiffening rib is arranged in the longitudinal support, which extend on both sides of the web outwardly from the web in the transverse direction and are configured such that the force flow is guided from the wheelset guide bushing into the transverse supports. Shear forces and transverse forces act on the chassis frame, mainly in the region of the wheelset guide bushing in which the wheel forces, for example, from the rolling resistance and the transverse forces arising from the wheel-rail contact are conducted in from the wheelset guide into the chassis frame. The forces are substantially conducted via the transverse supports to the superstructure or the respective other longitudinal supports. As a result, the region of the longitudinal support that is arranged between the wheelset guide bushing and the transverse support is particularly highly loaded. The stiffening ribs serve to conduct the force flow from the wheelset guide bushing into the transverse supports and thus to prevent a high loading of the web. In order to achieve such a conduction of the force flow, the ribs extend from a region of the longitudinal support in which the wheelset guide bushing is arranged into a region or the central portion of the longitudinal support in which the longitudinal support is connected to the transverse support. With the stiffening ribs that protrude from the web at a right angle on both sides thereof, a significant increase in the shearing rigidity and the transverse rigidity of the chassis frame is achieved, because the deformation capability of the longitudinal supports is restricted by the ribs. The ribs themselves are typically constructed as sheet metal parts that do not protrude from the longitudinal support, but extend in the transverse direction not more than to the outer edge of the longitudinal support top flange or the longitudinal support bottom flange.

In a preferred embodiment, the transverse support is configured as a bent part and has apertures at least at the transverse support top flange and at the transverse support bottom flange, where one of the apertures occupies at least 50% of the area of the transverse support top flange or the transverse support bottom flange. Such a construction enables a further reduction in the torsional stiffness of the chassis frame. As a result, the rib extends to that part of the transverse support (i.e., either the transverse support top flange or the transverse support bottom flange) that has a larger shearing rigidity, i.e., in other words to that part of the transverse support that has the smaller aperture.

In a further embodiment of the chassis frame in accordance with the invention, the web serves as a symmetry plane between, respectively, two stiffening ribs. With this, an even tension distribution is achieved in the longitudinal support and in the ribs themselves so that the stiffnesses on both sides of the web are configured equal.

In order to absorb the forces effectively from the wheelset guide, in a further embodiment of the invention, a first connection site at which the rib is connected to the wheelset guide bushing is arranged on the side of the wheelset guide bushing facing toward the transverse support. The shear forces and transverse forces acting on the wheelset guide bushing are to be guided into the transverse support. As a result, the side of the wheelset guide bushing facing toward the transverse support is particularly suitable for connection to the ribs. A further reason for such an arrangement of the first connection site is that the wheelset guide bushing has a longitudinal axis that is oriented parallel to the transverse direction and that the wheelset guide bushing extends over the whole width, i.e., the dimension in the transverse direction of the longitudinal support or the longitudinal support top flange or the longitudinal support bottom flange, a region forms on each side of the web in which the web and the wheelset guide bushing enclose a right angle.

Since the main loading acts through the shear forces in the region of the wheelset guide bushing that is closest to the transverse support, in accordance with a further preferred embodiment of an inventive chassis frame, the first connection site is arranged in the region of the wheelset guide bushing that has the smallest spacing from the transverse support, seen in the longitudinal direction. If the projection of the longitudinal support is viewed in the transverse direction, the point at which the first connection site is formed is usually the point at the periphery of the wheelset guide bushing that defines the maximum extent of the wheelset bushing in the longitudinal direction and thus in a direction normal to the longitudinal direction and the transverse direction centrally at the periphery of the wheelset guide bushing.

An advantageous configuration of the longitudinal support for three-dimensional deflection of the forces as a cranked longitudinal support provides that the longitudinal support has at least one transition portion adjoining the central portion in which the longitudinal support top flange and the longitudinal support bottom flange enclose an acute angle with one another and that the wheelset guide bushing is arranged in the transition portion in the region of the longitudinal support bottom flange. The transition between the central portion of the longitudinal support and an end portion parallel thereto for receiving a primary suspension of the rail vehicle herein occurs via the transition portion that is determined by the course of the longitudinal support top flange and the longitudinal support bottom flange. However, because the longitudinal support top flange and the longitudinal support bottom flange do not extend parallel to one another in the transition portion, the transition portion of the longitudinal support bottom flange begins, seen in the longitudinal direction, at a different point from that of the longitudinal support. In order to conduct the shear forces effectively into the chassis frame, the wheelset guide bushing is herein arranged close to the longitudinal support bottom flange in the transition portion of the longitudinal support, so that a simple connection of the wheelset guide via the wheelset guide bushing or a wheelset bearing is possible via the primary suspension on the longitudinal support, for example, on a spring cup arranged on the end portion.

In accordance with a further preferred embodiments of the invention, a second connection site at which the rib is connected to the longitudinal support and by which the force flow is conducted into the transverse support is arranged on the longitudinal support top flange. The connection to the longitudinal support top flange via the second connection site herein represents a simply configured connection of the rib to the longitudinal support. In particular, if the transverse support top flange has a greater shearing rigidity than the transverse support bottom flange, then the forces can thus be conducted via the longitudinal support top flange directly into the transverse support top flange, so that the force flow is as short as possible and the more highly loadable transverse support top flange directly absorbs a large part of the forces.

The design of the first and second connection site can herein be configured as a force-fitting connection, for example, via screws or rivets, although the connection site is preferably configured as a form-fitting connection, in particular as a weld seam between the rib and the respective element forming the connection site. Here, the connection sites typically delimit the rib and are configured on sides of the rib from end edges of the rib.

In a further preferred embodiment of a chassis frame in accordance with the invention, the second connection site is arranged in the central portion of the longitudinal support top flange. The central portion of the longitudinal support top flange is connected to the transverse support top flange. As a result, with such an arrangement of the second connection site, the force transfer between the rib and the transverse support is particularly easily achievable, because the force flow of the rib via the central portion of the longitudinal support top flange is conducted directly into the transverse support top flange.

However, because the central portion of the longitudinal support top flange is mostly completely configured for connecting the longitudinal support to the transverse support and thus no structural space is available at which the rib could open directly into the central portion, in a particularly preferred embodiment of the invention the second connection site is arranged at the transition between the central portion and the transition portion of the longitudinal support top flange, preferably within a transition radius.

This transition is always very close to the transverse support so that the length of the force flow is only slightly increased in relation to an above-described arrangement of the second connection site, although the corresponding structural space for connecting the rib to the longitudinal support top flange is available. It is herein particularly advantageous if the second connection site is arranged within a transition radius between the central portion and the transition portion of the longitudinal support top flange, because the rib thus additionally supports this highly loaded transition portion on which three-dimensional force deflections occur. It is self-evident that the second connection site can also be arranged in the region of the transition portion of the longitudinal support top flange adjoining the transition radius.

If the force flow is to occur mainly via the transverse support bottom flange, for example, because it has a greater shearing rigidity, for example, due to a smaller aperture, than the transverse support top flange, then in an alternative embodiment of the invention the second connection site is arranged on the longitudinal support bottom flange in the central portion of the longitudinal support bottom flange.

Since the longitudinal support bottom flange typically has a greater dimension in the longitudinal direction than the longitudinal support top flange and thus only part of the longitudinal support bottom flange is connected to the transverse support bottom flange, in a preferred embodiment of the alternative embodiment the second connection site is arranged in the region of the transverse support on the longitudinal support bottom flange. It is thus ensured again that the force flow is conducted as directly as possible from the rib into the transverse support. In further alternative embodiments, the rib has a fork and is connected both to the longitudinal support top flange and also to the longitudinal support bottom flange.

In a further embodiment of an inventive chassis frame, the projection of the rib in the transverse direction is a straight line. A projection should be understood in the following, as is widely known, to be the two-dimensional line or figure that is presented by observation of the rib in a defined direction. In other words, the projection of the rib in the transverse direction corresponds to the line which the shape of the rib presents in a side view. Thus, the rib forms a continuous surface and is particularly economically producible from the manufacturing standpoint.

The stiffening ribs in the region of the first connection site are to enclose the flattest possible angle between 1° and 30°, preferably between 5° and 25°, with the longitudinal direction and at the same time the angle at the second connection site between the rib and the longitudinal support top flange or the longitudinal support bottom flange must not be too acute, in order to be able to absorb and transmit the shear forces well. Consequently, a straight projection is in part not achievable by design means. Therefore, in a further alternative embodiment of an inventive chassis frame, the projection of the rib in the transverse direction has a kink that subdivides the rib into a first rib portion and a second rib portion. Thus, the first and the second connection site can be adapted to the respectively necessary angle regions since, via the kink, the necessary free design space is provided. The kink can also be a rounded transition without a sharp edge.

In a preferred embodiment of the further alternative embodiment, the kink divides the rib in a ratio of between 1:1 and 1:2. Here, the kink lies, in any event in the central third of the rib in order to achieve a good stress flow. It is herein also conceivable to provide more than one kink. It is also advantageous if the rib portions enclose an obtuse angle, preferably between 175° and 120°, more preferably between 175° and 150°. With the obtuse transition between the two rib portions, a gentle deflection of the force flow is achieved and stress concentrations in the kink are largely prevented.

In order to connect, preferably to weld, the rib to the web, in a particularly preferred embodiment of an inventive chassis frame, the rib has a first longitudinal edge facing toward the web and a second longitudinal edge facing away from the web, where the rib is connected at the first longitudinal edge at least partially to the web. The outline of the rib is thus herein delimited by the two longitudinal edges in the transverse direction and, normal to the transverse direction, the outline of the rib is delimited by the first and second connection site that are configured as end edges of the rib. The first longitudinal edge is therein either completely or only partially connected to the web, where the connection preferably occurs via a weld seam on each of the top side and the bottom side of the rib.

In accordance with a further preferred embodiment of the invention, the projection of the second longitudinal edge in a direction normal to a plane spanned by the longitudinal direction is a straight line. The projection herein corresponds to the imaginary representation of the outline of the rib in a plan view, i.e., seen from above or below. With this, the shearing rigidity and the transverse rigidity of the longitudinal support and thus also the corresponding rigidity of the chassis frame is greatly increased, because the rib formed thereby severely restricts the deformation capability of the longitudinal support. The projection of the first longitudinal edge is herein not necessarily parallel to the projection of the second longitudinal edge. Preferably, the first connection site measured in the transverse direction is shorter than the second connection site, for which reason the extensions of the projections of the longitudinal edges enclose an acute angle.

The longitudinal support itself can be subjected to a twisting about its longitudinal axis via a torsion moment or via a force forming a torsion moment. Consequently, a straight second longitudinal edge leads to a connecting weld seam between the first longitudinal edge and the web being particularly strongly loaded in the central third of the rib, because the I-profile of the longitudinal support is particularly severely twisted in this region. In order to relieve the weld seam, in a further alternative embodiment of the invention the projection of the second longitudinal edge in a direction normal to a plane spanned by the longitudinal direction is at least partially curved and preferably has the form of an ellipse. With the curvature, herein a favorable stress flow in the rib is created, where the curvature is preferably formed at least in the central third of the rib.

In a further particularly preferred embodiment of the invention, the rib has a constriction in the region of the second longitudinal edge. With the constriction or waisting of the rib in the transverse direction, for example, via a partial curvature of the second longitudinal edge, a reduction of the loading of the connecting weld seam is also achieved. It is herein advantageous if the constriction is configured such that the width of the rib in the transverse direction in the region of the maximum of the constriction is between 15% and 50%, more preferably between 20% and 35%, of the maximum width of the rib in the transverse direction.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For further explanation of the invention, reference will be made in the following section of the description to the drawings which illustrate further advantageous embodiments, details and developments of the invention. The figures are to be regarded as exemplary and are intended to illustrate the character of the invention, but do not in any way restrict it or represent it exclusively, in which.

DETAILED DESCRIPTION OF THE EXEMPLARY EMBODIMENTS

Figure 1:
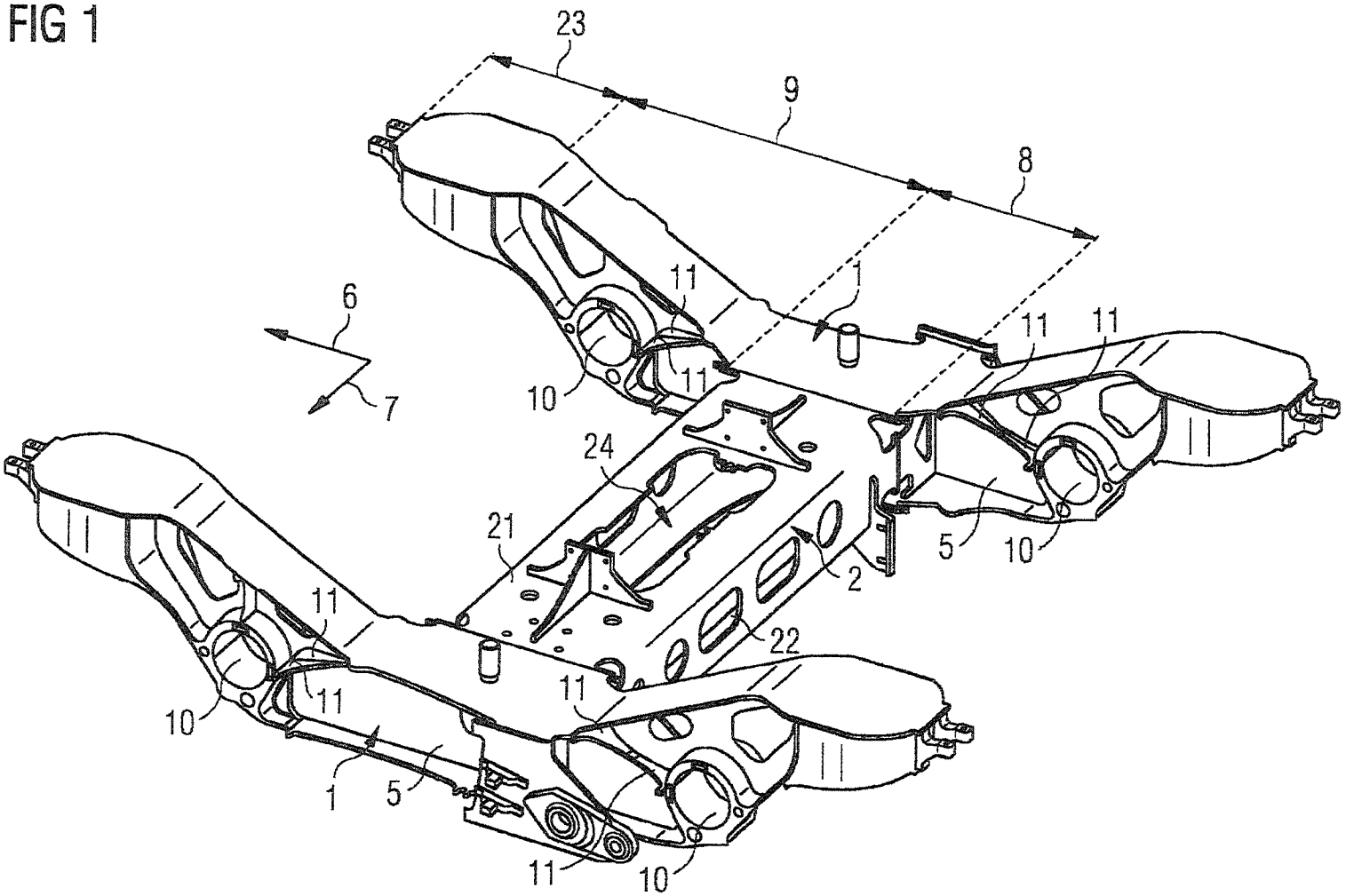
FIG. 1 shows an axonometric view of a chassis frame in accordance with the invention.

FIG. 1 shows a three-dimensional representation of an embodiment of an inventive chassis frame for a rail vehicle. This comprises herein two longitudinal supports 1 that are oriented parallel to a longitudinal direction 6, and a transverse support 2 connecting the two longitudinal supports 1, which is oriented parallel to a transverse direction 7 arranged normal to the longitudinal direction 6. The longitudinal direction 6 herein corresponds to the direction of travel of the rail vehicle in the operating state.

The longitudinal supports 1 are herein configured as I-beams and thus have a longitudinal support top flange 3, a longitudinal support bottom flange 4 and a web 5 connecting both symmetrically. A cranked form of the longitudinal support 1 is provided in that it has a central portion 8 and, in the longitudinal direction 6, respectively in front of and behind the central portion 8, an end portion 23 parallel to the central portion 8, where the portions 8, 23 are connected by a transition portion 9 extending obliquely. In the central portion 8 of the longitudinal support 1, the longitudinal support top flange 3 and the longitudinal support bottom flange 4 herein extend parallel to one another. The connection to the transverse support 2 also occurs in the central portion 8. For the connection of the chassis frame to a wheelset guide, each longitudinal support 1 has two wheelset guide bushings 10 that have a circular cross-section and serve to receive a pin of the wheelset guide. The longitudinal axes of the wheelset guide bushings 10 are herein oriented parallel to the transverse direction 7.

In the present exemplary embodiment, the transverse support 2 is configured as a single-piece box-shaped bent part which, on the transverse support bottom flange 22, has two first edges welded to one another and, on the transverse support top flange 21 as well as on the transverse support bottom flange 22 and the side walls, has an aperture 24 (in the figure, for the sake of clarity, only one aperture 24 is shown), in order to lessen the torsional stiffness of the chassis frame.

With the wheelset guide bushings 10, shear forces and transverse forces are conducted into the chassis frame, in order to achieve a pre-determined shearing rigidity or transverse rigidity of the chassis frame, for each wheelset guide bushing 10. Consequently, two stiffening ribs 11 are arranged in the longitudinal support 1 or are connected to the longitudinal support 1, where the ribs 11 extend outwardly on both sides of the web 5 symmetrically to the web 5, i.e., in the transverse direction 7 away from the web 5. Overall, therefore, four ribs 11 are provided on each longitudinal support 1 and in the whole chassis frame, eight ribs 11.

Figure 2:
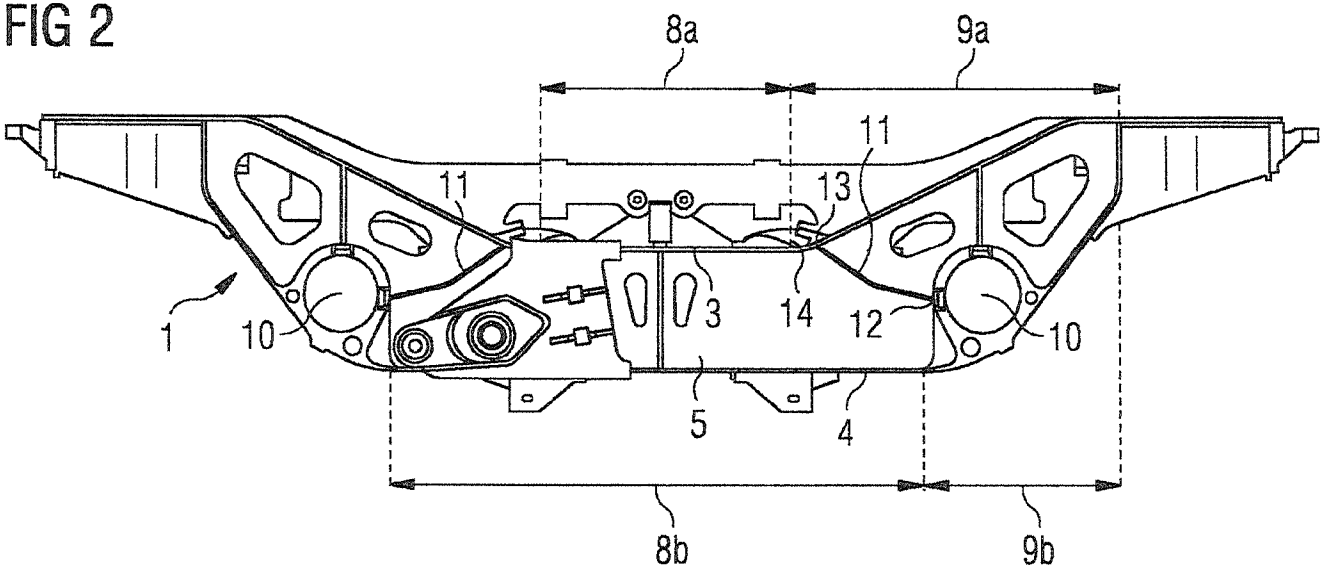
FIG. 2 shows a side view of the chassis frame of FIG. 1.

FIG. 2 shows a side view of the chassis frame in which essentially the longitudinal support 1 is to be seen. Here, it is readily visible that the central portion 8 of the longitudinal support 1 has approximately the shape of a parallelogram, because the central portion 8*a* of the longitudinal support top flange 3 is shorter than the central portion 8*b* of the longitudinal support bottom flange 4. For this reason, the transition portion 9*a* of the longitudinal support top flange 3 is longer than the transition portion 9*b* of the longitudinal support bottom flange 4. In the region of the transition portion 9, the longitudinal support top flange 3 and the longitudinal support bottom flange 4 do not extend parallel to one another, but enclose an acute angle to one another. The wheelset guide bushing 10 is herein arranged in the transition portion 9, more precisely, in the transition portion 9*b* of the longitudinal support bottom flange 4, and adjoins the longitudinal support bottom flange 4.

A first connection site 12 that connects the rib 11 to the wheelset guide bushing 10 is herein arranged at the point of the wheelset guide bushing 10 that is closest to the transverse support 2. In other words, the first connection site 12 is therefore arranged, in a height direction that is defined by the normal vector of the longitudinal direction 6 and the transverse direction 7, centrally at the periphery of the wheelset guide bushing 10, because this has the greatest extent in the center in the longitudinal direction 6 and is thus closest to the transverse support 2. The first connection site 12 can also begin at another point of the wheelset guide bushing 10, although what is important herein above all is that the first connection site 12 is arranged on the side of the wheelset guide bushing 10 facing toward the transverse support 2, in order to be able to absorb the shear forces.

A second connection site 13 that connects the rib 11 to the longitudinal support top flange 3 is arranged on the longitudinal support top flange 3 in the region of the transition between the central portion 8*a* and the transition portion 9*a* of the longitudinal support top flange 3. In this transition, the longitudinal support top flange 3 forms a transition radius 14, where the second connection site 13 connects the transition radius 14 from below to the rib 11.

However, it is equally conceivable that the second connection site is arranged in the central portion 8*a* of the longitudinal support top flange 3 or in the transition portion 9*a* of the longitudinal support top flange 3.

With the ribs 11, therefore, the force flow is conducted from the wheelset guide bushing 10 to the transverse support 2, more precisely, to the transverse support top flange 21. Due to the fact that the aperture 24 on the transverse support top flange 21 is smaller than that on the transverse support bottom flange 22 and the transverse support top flange 21 therefore has a greater shearing rigidity than the transverse support bottom flange 22, the second connection site 13 is arranged on the longitudinal support top flange 3 or the rib 11 is connected at the second connection site 13 to the longitudinal support top flange 3. In the event that the transverse support bottom flange 22 and the transverse support top flange 21 have the same shearing rigidity or that the shearing rigidity of the transverse support bottom flange 22 is greater, in alternative embodiments (not shown), the second connection site 13 is arranged in the central portion 8*b* of the longitudinal support bottom flange 4, preferably in the region of the connection to the transverse support 2.

Figure 3:
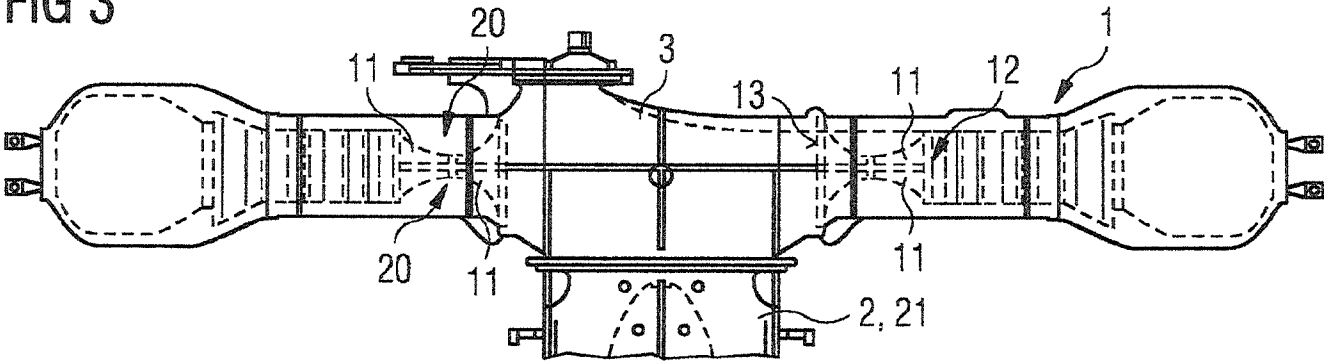
FIG. 3 shows a partial representation of a plan view of a chassis frame with a transparently represented longitudinal support top flange in accordance with the invention.

Shown in FIG. 3 is a plan view of the chassis frame, where the longitudinal support top flange 3 is rendered transparent for simpler representation of the ribs 11. Here, in particular, the symmetrical orientation of the ribs 11 to the web 5 is readily apparent. Furthermore, it is made clear that the first and second connection sites 12, 13 are formed by end edges of the ribs 11, where, when seen in the transverse direction 7, the second connection sites 13 extend further outwardly than the first connection sites 12. Between the connection sites 12, 13, herein the ribs 11 have a constriction 20. In order to connect the ribs 11 at the connection sites 12, 13 to the longitudinal supports 1, weld seams are provided.

Figure 4:
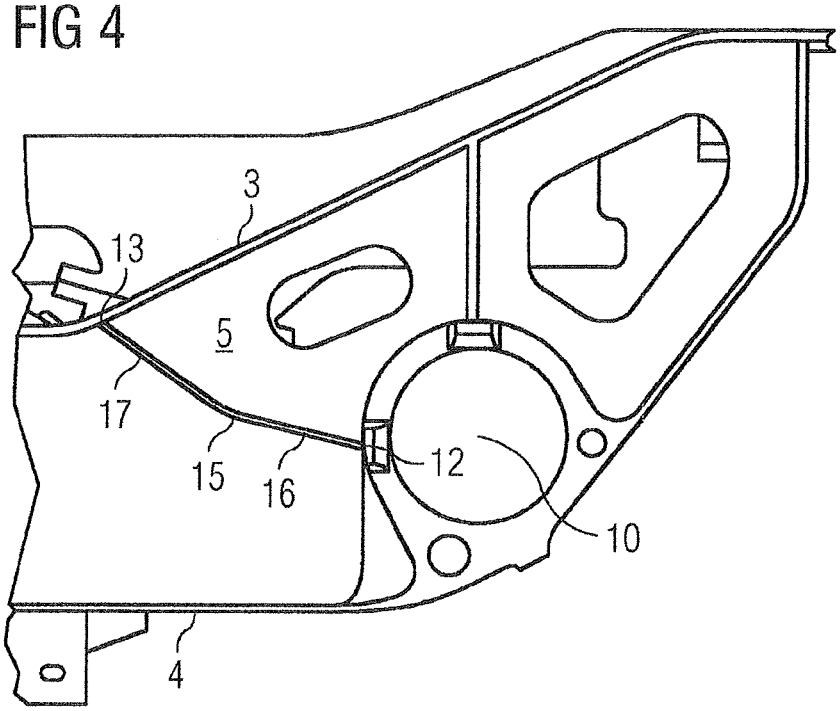
FIG. 4 shows a detail view of a rib in the chassis frame in accordance with the invention.

FIG. 4 shows a rib 11 in detail, where it is particularly apparent that the rib 11 has a kink 15. This side view, which corresponds to a view in the transverse direction 7, therefore shows a projection of the rib 11 in which the kink 15 is clearly evident. The kink 15 herein divides the rib 11 into a first rib portion 16 and a second rib portion 17, where the rib portions 16, 17 or their projections in the transverse direction 7 enclose an angle of approximately 170° with one another. The angle that the first rib portion 16 encloses with the longitudinal direction 6 is approximately 20°, whereas the acute angle between the second rib portion 17 and the transition portion 9*a* of the longitudinal support top flange 3 is approximately 60°. The kink 15 herein divides the rib 11 in the middle third of the rib 11, in the present case into approximately equal-sized parts, and is provided with a rounding to achieve a more favorable stress flow. Alternatively, in further alternative embodiments, the projection of the rib 11 in the transverse direction 7 is a straight line to further simplify the production and mounting of the rib 11.

Figure 5:
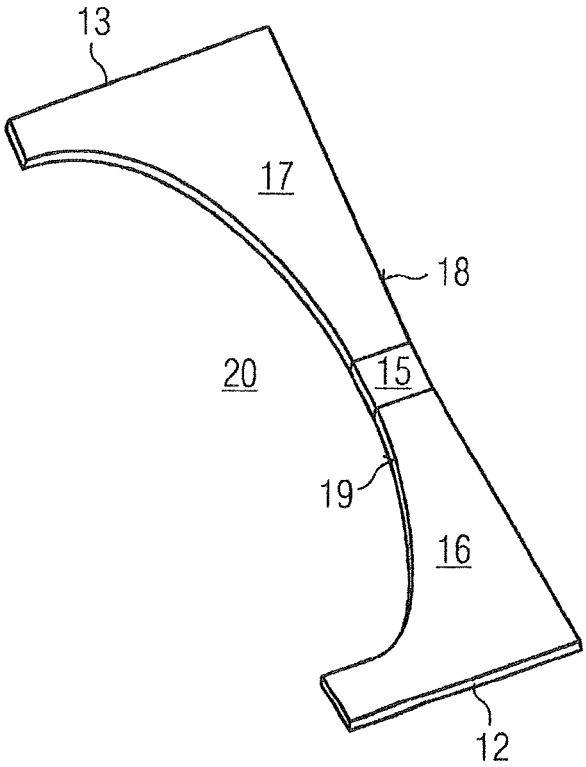
FIG. 5 shows an axonometric view of the rib of FIG. 4.

In FIG. 5, a three-dimensional representation of a rib 11 is shown without a chassis frame. Here, it is particularly clearly apparent that the outline of the rib 11 is formed, firstly, in the longitudinal direction 6 by the end edges forming the connection sites 12, 13 and, secondly, in the transverse direction 7 by a first longitudinal edge 18 which, in the installed state, lies on the web 5 and, on the side opposite to the first longitudinal edge 18, by a second longitudinal edge 19. The first longitudinal edge 18 is composed of two straight portions in the region of the two rib portions 16, 17 and a curved portion in the region of the kink 15, where the first longitudinal edge 18 is oriented, in a projection in the height direction, parallel to the longitudinal direction 6 and thus lies along the entire first longitudinal edge 18 against the web 5. Here, the rib 11 is connected to the web 5 via two connecting weld seams along the entire length of the first longitudinal edge 18, which connecting weld seams extend on the upper and lower side of the rib 11.

The second longitudinal edge is composed in this exemplary embodiment of two straight portions in the region of the connection sites 12, 13 and a curved, elliptical-shaped portion that forms the constriction 20. Here, The constriction 20 is configured so that the minimum of the width of the rib 11 in the width direction 7 lies in the region of the kink 15 and the constriction occupies approximately 45% of the theoretical area of the rib 11 between the first longitudinal edge 18 and the straight portions of the second longitudinal edge 19. It is self-evident that this design of the rib would also be recognizable in a plan view of the rib 11, in other words if the outline of the rib 11 in the height direction were to be projected onto an area spanned by the longitudinal direction 6 and the transverse direction 7. In a further alternative embodiment, it is also conceivable that the second longitudinal edge 19 is configured, in a plan view, as a straight line.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A chassis frame for a rail vehicle, comprising:

a plurality of longitudinal supports which extend parallel to a longitudinal direction and are configured as I-beams, each of the plurality of longitudinal supports comprising a longitudinal support top flange, a longitudinal support bottom flange and a web; and a box-shaped transverse support which extends normal to the longitudinal direction and parallel to a transverse direction and interconnects the plurality of longitudinal supports;

wherein each of the plurality of longitudinal supports have a central portion in which the longitudinal support top flange and the longitudinal support bottom flange are arranged parallel to one another and in which each of the plurality of longitudinal supports is connected to the transverse support;

wherein each of the plurality of longitudinal supports forms at least one wheelset guide bushing for connecting to a wheelset guide;

wherein at least one stiffening rib is arranged in each of the plurality of longitudinal supports on both sides of the web and extends on both sides of the web outwardly from the web in the transverse direction and is configured such that a force flow from the at least one wheelset guide bushing is conducted into the transverse support; and wherein a first connection site connects the rib to the at least one wheelset guide bushing and a second connection site connects the rib to the longitudinal support top flange or to the longitudinal support bottom flange.

2. The chassis frame as claimed in claim 1, wherein the web serves as a symmetry plane between two stiffening ribs, respectively.

3. The chassis frame as claimed in claim 2, wherein a first connection site at which a stiffening rib is connected to the wheelset guide bushing is arranged on a side of the wheelset guide bushing facing toward the transverse support.

4. The chassis frame as claimed in claim 1, wherein a first connection site at which a stiffening rib is connected to the wheelset guide bushing is arranged on a side of the wheelset guide bushing facing toward the transverse support.

5. The chassis frame as claimed in claim 4, wherein the first connection site is arranged in a region of the wheelset guide bushing having a least spacing, seen in the longitudinal direction, from the transverse support.

6. The chassis frame as claimed in claim 1, wherein each of the plurality of longitudinal supports includes at least one transition portion adjoining the central portion, in which the longitudinal support top flange and the longitudinal support bottom flange, enclose an acute angle with one another; and wherein the wheelset guide bushing is arranged in the at least one transition portion in a region of the longitudinal support bottom flange.

7. The chassis frame as claimed in claim 6, wherein the second connection site is arranged at a transition between the central portion and a transition portion of the longitudinal support top flange.

8. The chassis frame as claimed in claim 7, wherein the second connection site is arranged within a transition radius.

9. The chassis frame as claimed in claim 1, wherein a second connection site at which the rib is connected to the longitudinal support and by which the force flow is conducted into the transverse support is arranged on the longitudinal support top flange.

10. The chassis frame as claimed in claim 9, wherein the second connection site is arranged in a central portion of the longitudinal support top flange.

11. The chassis frame as claimed in claim 9, wherein the second connection site is arranged at a transition between the central portion and a transition portion of the longitudinal support top flange.

12. The chassis frame as claimed in claim 1, wherein a projection of the at least one stiffening rib in the transverse direction is a straight line.

13. The chassis frame as claimed in claim 1, wherein a projection of the least one stiffening rib in the transverse direction has a kink which subdivides the rib into a first rib portion and a second rib portion.

14. The chassis frame as claimed in claim 13, wherein the kink divides the rib in a ratio of between 1:1 and 1:2.

15. The chassis frame as claimed in claim 14, wherein the first and second rib portions enclose an obtuse angle.

16. The chassis frame as claimed in claim 15, wherein the obtuse angle is between 175° and 150°.

17. The chassis frame as claimed in claim 13, wherein the first and second rib portions enclose an obtuse angle.

18. The chassis frame as claimed in claim 17, wherein the obtuse angle is between 175° and 120°.

19. The chassis frame as claimed in claim 1, wherein the at least one stiffening rib has a first longitudinal edge facing toward the web and a second longitudinal edge facing away from the web; and wherein the at least one stiffening rib is connected at the first longitudinal edge at least partially to the web.

20. The chassis frame as claimed in claim 19, wherein a projection of the second longitudinal edge in a direction normal to a plane spanned by the longitudinal direction is a straight line.

21. The chassis frame as claimed in claim 19, wherein a projection of the second longitudinal edge in a direction normal to a plane spanned by the longitudinal direction is at least partially curved and has the form of an ellipse.

22. The chassis frame as claimed in claim 21, wherein the at least one stiffening rib includes a constriction in a region of the second longitudinal edge.

23. The chassis frame as claimed in claim 19, wherein the projection of the second longitudinal edge in a direction normal to a plane spanned by the longitudinal direction is forms an ellipse.

24. The chassis frame as claimed in claim 19, wherein the at least one stiffening rib includes a constriction in a region of the second longitudinal edge.

* * * * *